US006769545B1

(12) United States Patent
Mallams

(10) Patent No.: US 6,769,545 B1
(45) Date of Patent: Aug. 3, 2004

(54) MEDICATION MANAGEMENT SYSTEM AND METHOD

(76) Inventor: George E. Mallams, 1376 Greenvista La., Gulf Breeze, FL (US) 32563-3468

( * ) Notice: Subject to any disclaimer, the term of this patent is extended or adjusted under 35 U.S.C. 154(b) by 65 days.

(21) Appl. No.: 10/178,585

(22) Filed: Jun. 24, 2002

(51) Int. Cl.[7] ..... B65D 83/04
(52) U.S. Cl. ..... 206/534; 206/459.5
(58) Field of Search ..... 206/459.1, 459.5, 206/534; 434/236, 238, 259; 40/312; 116/222, 307, 308, 325, 326, DIG. 1

(56) References Cited

U.S. PATENT DOCUMENTS

| | | | | | |
|---|---|---|---|---|---|
| 400,345 | A | | 3/1889 | Kennedy | |
| 692,166 | A | | 1/1902 | Schutter | |
| 3,278,010 | A | | 10/1966 | Katz | 206/42 |
| 3,675,620 | A | | 7/1972 | Baustin | 116/121 |
| 3,841,260 | A | | 10/1974 | Sharp et al. | 116/136 |
| 4,148,273 | A | | 4/1979 | Hollingsworth et al. | 116/325 |
| 4,314,418 | A | * | 2/1982 | Narens et al. | |
| 4,389,963 | A | | 6/1983 | Pearson | 116/308 |
| D281,176 | S | | 10/1985 | Sukovich | D20/18 |
| 4,749,085 | A | | 6/1988 | Denney | 206/534 |
| 4,815,767 | A | | 3/1989 | Lambert | 283/67 |
| 4,889,237 | A | | 12/1989 | Brandon | 206/534 |
| 4,905,388 | A | | 3/1990 | Sinkow | 40/110 |
| 4,955,481 | A | * | 9/1990 | Novinski et al. | |
| 5,261,702 | A | | 11/1993 | Mayfield | 283/115 |
| 5,351,818 | A | | 10/1994 | Daneshvar | 206/216 |
| 5,431,450 | A | | 7/1995 | Coleman | 283/62 |
| 5,941,394 | A | * | 8/1999 | Siegler | |
| 5,979,698 | A | * | 11/1999 | Deal | |
| 6,293,403 | B1 | | 9/2001 | Holmberg | 206/534 |

* cited by examiner

*Primary Examiner*—David T. Fidei
(74) *Attorney, Agent, or Firm*—Peter Loffler

(57) ABSTRACT

A medication management system uses a container that holds all medicine bottles wherein the medicine stored therein is taken on the same time schedule. A peg is placed into an opening located on the container wherein a label that has printing thereon that corresponds to the time of the current medicine consumption located proximate the opening wherein the peg is placed. The peg is moved after the satisfaction of each time within the schedule. Multiple containers are provided, each having a labeling system that corresponds to the time regiment of the medicines being stored within the particular container.

10 Claims, 3 Drawing Sheets

MEDICATION MANAGEMENT SYSTEM AND METHOD

BACKGROUND OF THE INVENTION

1. Field of the Invention

The present invention relates to a system that aids people in the timely taking of medication and the management of taking the medication.

2. Background of the Prior Art

Many medicines, if not appropriately time managed, will loose some if not all of their efficacy. Accordingly, one challenge for people taking medication is remembering to take the medication at the appropriate times as prescribed by the doctor. For a person taking a medication on an ad hoc basis, such as the poison ivy sufferer on a twelve day prednisone program, this challenge is easy enough. Such a person, having acquired a temporary malady, is made uncomfortable by the malady, and is quite motivated to return to a normal state and such a person tends to be very successful in substantially fulfilling the medication regime established by that person's physician.

More often the problem is found with the person who suffers from a long term or even chronic problem such as a person suffering from arthritis. Over time, such a person becomes accepting of the condition and may loose some of the strong desire to fight the ailment experienced initially upon acquiring the condition, especially upon realizing that the condition is only being managed and not cured. In such circumstances, the person reaches a plateau with the condition and looses some connection between the medication being taken and its effects on the condition. Such a person may tend to be less than perfect in following the medication regiment.

The problems grow more acute for a person who suffers from more than one ailment or who is required to take more than one medication for the ailment from which the person suffers. Medications come in a wide variety of regiments. Some medications are taken three times a day, some are taken in the morning before a meal, some are taken in the morning after a meal. Some medications are taken every other day, some are taken every four hours while others are taken every six or eight hours. Countless other regiments are known depending on the medication, the condition being treated, the particular person taking the medication, the other medications being taken by the person, etc. For all but the most organized and motivated individual, errors in following the regiment of one or more medications will occur, sometimes with very adverse results. Even if the person is very determined, a medication bottle may be visually missed by such a person as the sea of medication bottles is surveyed in the medicine cabinet during known pill taking times.

One system that many people employ in order to overcome the problem with multiple medication regiments, is that such people will, either at the end of every night or first thing in the morning, take out every pill that is to be taken that day and place the pills in a single container and will take each pill at the appropriate time. Some such systems will have multiple cavities so that the pills may be placed into, for example seven different cavities so that an entire week's worth of medication can be prepared and stored at one time.

While this system may prove more reliable for many individuals than pure rote memory, it has many drawbacks. In the first place, many people many not recognize the pills once they are out of the container and may improperly take the medication at the wrong time, believing the pill to be a different pill. Furthermore, some pills in prolonged contact with other pills may contaminate such other pills potentially leading to adverse effects. Additionally, the containers that are used to hold such pills tend to lack the child safety features found on modern medicine bottles creating the potential for a child to easily gain access to the medication stored therein.

Another method employed to keep people on track with their medication regiment is to use some form of calendering system, which system is located proximate the storage area of the medicine. Such calendering systems typically have each medication listed along with the times each medication is to be taken and some form of check off system for recording the consumption of each medication. Such systems work reasonably well, although shortcomings can be found.

Typically, a calendering system is attached to a fixed point such as a wall that is close to the storage location of the medication or is attached to the inside cupboard door wherein the medication is being stored. This means that the calendering system is one step removed from the medication. A person must retrieve and take the medication and then turn to the calendering system to make the appropriate entry. While this is not a big step, it can be easy to forget especially for a relatively busy person. Additionally, a person who frequently travels may forget to take the calendering system along with the medication when traveling.

Therefore, there exists a need in the art for a medication management system that addresses the above-stated problems in the art. Specifically, such a system must provide a convenient method whereby a person can manage one or more medication taking regiments. Such a system must allow the medication to remain in its original container without the need to be transferred to a container that is less child safe or where the medication can adversely interact with other medications. Such a system must be intertwined with the medication itself and must provide for ease of travel for the person who travels. Ideally, such a system should be relatively simple in design and operation.

SUMMARY OF THE INVENTION

The medication management system and method of the present invention address the aforementioned needs in the art. Specifically, the medication management system provides a convenient method whereby a person can manage one or more medication taking regiments quickly and easily. The medication management system allows the medication to remain in its original container and does not require that the medication be transferred to a container that is less child safe or where the medication can adversely interact with other medications. The medication management system of the present invention is intertwined with the medication itself and provides for ease of travel for the person who travels. The medication management system is of relatively simple design and is simple in operation.

The medication management system of the present invention is comprised of a first container that has a first base, a first side wall extending upwardly from the first base, and a first open top, the first container being adapted to hold a first medicine bottle, which first medicine bottle holds a first medicine therein which first medicine is to be consumed by a person on a first regiment of time. A plurality of first openings are located on the first side wall. At least one first label is located proximate one of the plurality of first openings, each first label having first markings thereon that correspond to the first regiment of time of the first medicine. A first peg is receivable within one of the plurality of first openings. A second container has a second base, a second side wall extending upwardly from the second base, and a second open top, the second container being adapted to hold a second medicine bottle, which second medicine bottle holds a second medicine therein which second medicine is to be consumed by the person on a second regiment of time. A plurality of second openings are located on the second side wall. At least one second label is located proximate one of the plurality of second openings, each second label having second markings thereon that correspond to the second regiment of time of the second medicine. A second peg is receivable within one of the plurality of second openings. The first peg is received within the first opening that is located proximate the first label that corresponds to the most current first time within the first regiment that the first medicine has been consumed by the person and the second peg is received within the second opening that is located proximate the second label that corresponds to the most current second time within the second regiment that the second medicine has been consumed by the person. The first side wall is positioned in non-normal orientation relative to the first base and the second side wall is positioned in non-normal orientation relative to the second base. The first container is attached, either fixedly or removably, to the second container. The base of the first container may nest within the second open top of the second container.

BRIEF DESCRIPTION OF THE DRAWINGS

Similar reference numerals refer to similar parts throughout the several views of the drawings.

DESCRIPTION OF THE PREFERRED EMBODIMENT

Figure 1:
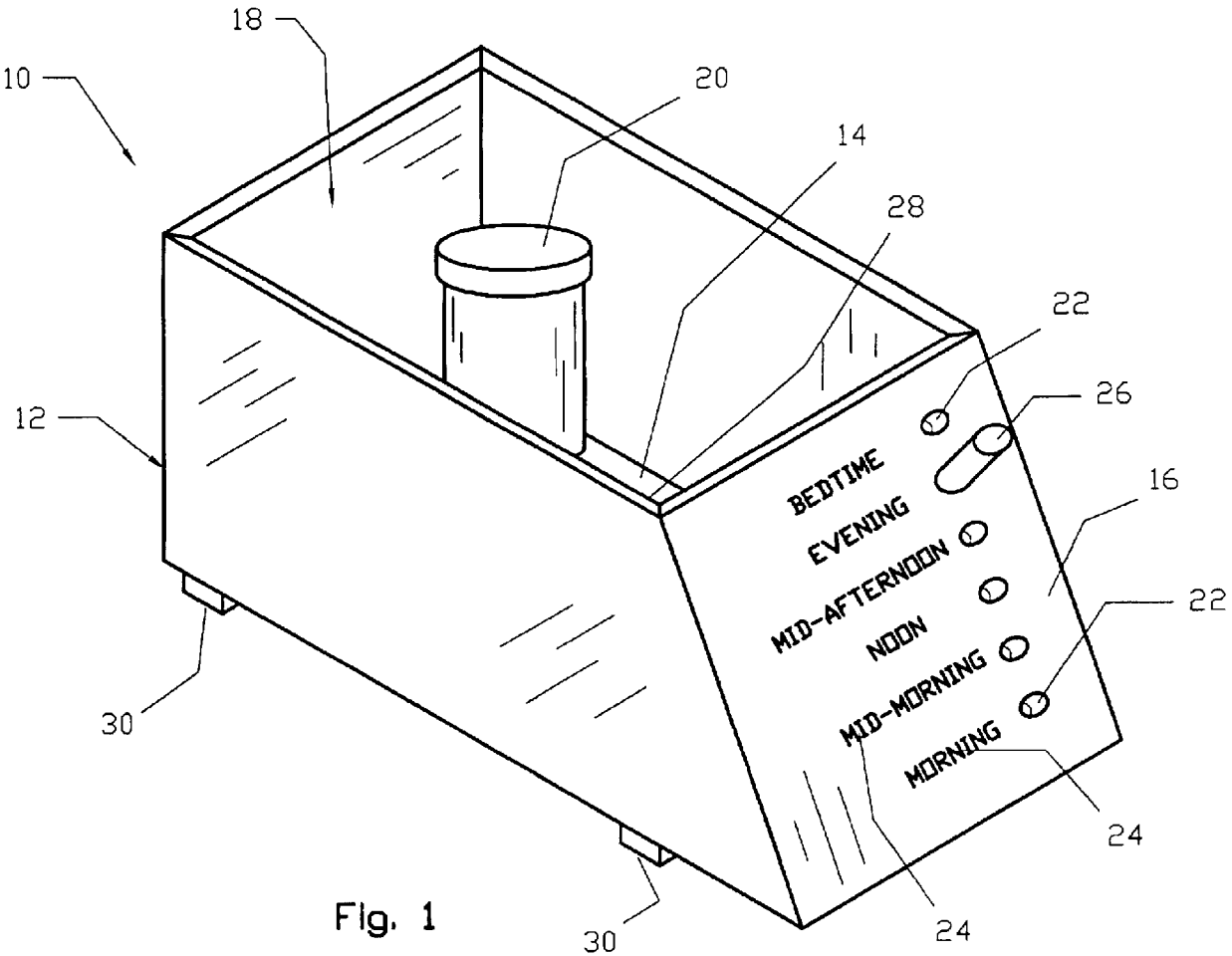
FIG. 1 is a perspective view of a container of the medication management system and method of the present invention.
Figure 2:
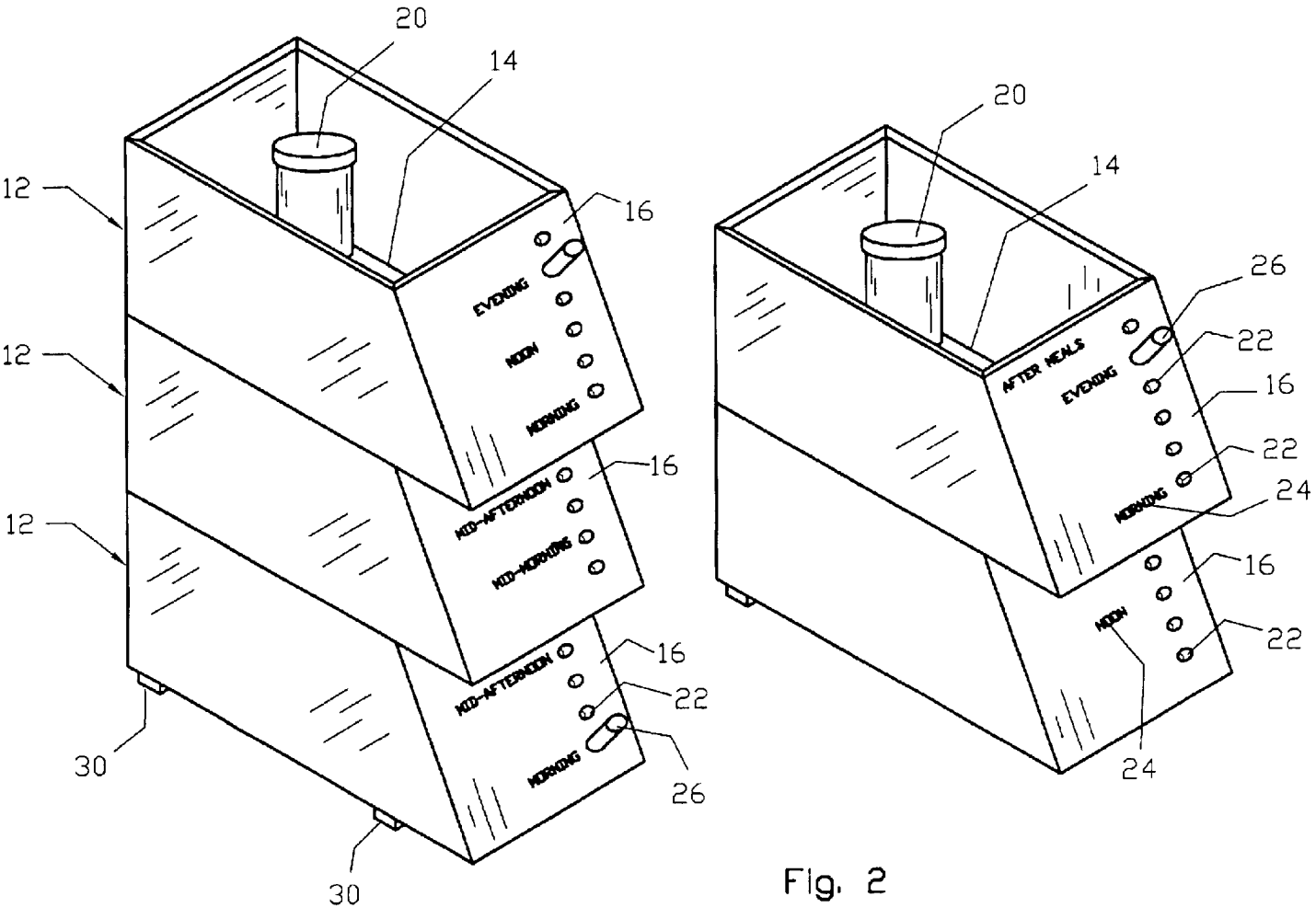
FIG. 2 is a perspective view of a plurality of containers of the medication management system and method of the present invention.

Referring now to the drawings, it is seen that the medication management system and method of the present invention, generally denoted by reference numeral 10, is comprised of a container 12 that has a base 14, a side wall 16 extending upwardly from the base 14, and a open top 18, the first container 12 holds a medicine bottle 20. The medicine bottle 20 holds a medicine (not illustrated) therein which medicine is to be consumed by a person on a regiment of time, such as once a day, morning noon and evening, three times a day, once every other day, every morning before a meal, every morning after a meal, twice a day, twice a day before a meal, twice a day after a meal, etc. A plurality of openings 22 are located on the side wall 16 of the container. At least one label 24 is located proximate one of the plurality of openings 22. The labels 24 have markings thereon that correspond to the regiment of time of the medicine. For example, if the regiment of time for the medicine is morning, noon, and evening, three labels are provided, one bearing "morning," the second label 24 bearing "noon," and the third label 24 bearing "evening." Each such label 24 in the above example is placed proximate a respective one of the openings 22 located on the side wall 16 of the container, advantageously, in expected order such as the above described morning, noon, and evening order. A peg 26 is receivable within one of the plurality of openings 22.

In order to use the medication management system and method 10 of the present invention, all medicine bottles 20 that have medicine that is taken on the same regiment of time—morning, noon, and evening in the above example—are placed into the container 12. The peg 26 is placed within the opening 22 that is located proximate the label 24 that corresponds to the most current time within the regiment that the medicine within the container 12 has been consumed by the user of the device 10. When the user needs to take medicine, each medicine bottle 20 is removed from the container 12, and the medicine is removed from each medicine bottle 20 and placed into an appropriate holding vessel, such as a cup (not illustrated). Once the medicine is placed into the holding vessel, the medicine bottle 20 is placed back into the container 12. Once all medicines for the particular time period within the regiment of time are in the holding vessel, the user places the peg 26 into the opening 22 that has the label 24 that corresponds to that time wherein the pills are then being taken in order to mark that time as being satisfied. The user consumes (orally, topically, etc.,) the medicine as appropriate. The process is repeated at the next time period. The container 12 may have extra openings 22 such that some openings 22 do not have a label 24 associated therewith. For example, a regiment of time that requires the user to take medicine once a day, will have a label 24 that so reads associated with an opening 22 and the remainder of the opening 22 or openings 22 will have no label 24 associated therewith. In such an embodiment, the user may, at bed time or first thing in the morning, place the peg 26 into one of the neutral openings 22 (an opening 22 not having a label 24 associated therewith), and once the medicine is consumed that day, the peg 26 is moved into the opening 22 that has the label 24 associated therewith. Alternately, each opening may have a label 24 associated therewith, and the peg 26 is cycled through the regime in a continues loop.

Figure 3:
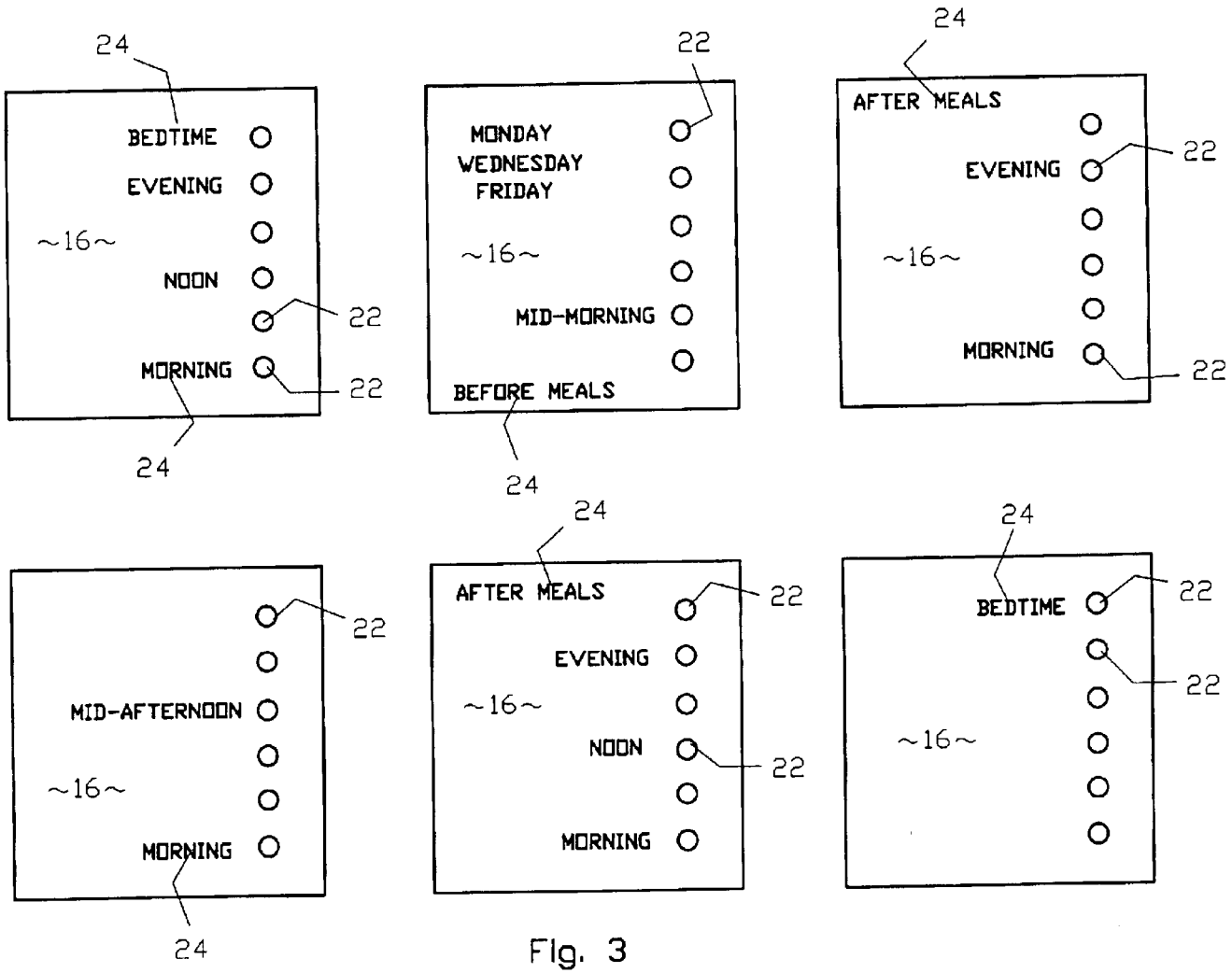
FIG. 3 is a plan view of several container side walls, each bearing a different set of labels corresponding to a different set of time regiments for medicine consumption.

Additional containers 12 are provided such that each additional container 12 is substantially similar to the container 12 described above except that each container 12 holds medicine bottles 20 that have unique regiments of time with respect to the other containers 12. For example, one container 12 holds medicine bottles 20 wherein the medicines stored therein are taken morning, afternoon, and evening, a second container 12 holds medicine bottles 20 wherein the medicines stored therein are taken once each morning before meals, and a third container holds medicine bottles 20 wherein the medicines stored therein are taken once each morning after meals. One container 12 is provided for each such regiment of time and the labels 24 that are placed on each particular container 12 correspond to the regiment of time of the medicines being held by that particular container 12. By way of example, a variety of time regiment possibilities are illustrated in FIG. 3.

The side wall 16 of each container 12 are mitered or are otherwise disposed non-normal relative to the base 14 so as to provide easier viewing of the labels 24 located on the side wall 16. A partition. 28 may be provided so-that a medicine bottle 20 does not become inadvertently hidden under the mitered side wall 16.

The labels 24 that are placed onto the side wall 16 may be conventional labels that are preprinted and placed onto the side wall 16 by the user in any standard fashion such as by adhesion, or the labels 24 may be blank labels onto which the user prints the appropriate time from the regiment of time and affixes the labels 24 to the side wall 16. Alternately, the labels 24 can be a fixed portion of the side wall 16 such that the labels are either preprinted on the side wall 16 or are printed thereon by the user to correspond to the desired time regiment.

The containers 12 can be attached together in any appropriate fashion such as abutting pairs of containers together back to back and securing them by way of double sided tape, cooperating hook and loop material, etc., or a string of containers 12 can be attached to each other is side to side fashion in similar attachment fashion. Additionally, the containers 12 can be stacked such that the lower portion of the base of one container 12 rests within the open top 18 of another container 12. One or more feet 30 can be provided on the base 14 in order to hold the upper container 12 relatively securely within the open top 18 of the lower container 12. Relatively secure stacking of multiple containers 12 allows multiple containers to be easily transported by the user during travel.

While the invention has been particularly shown and described with reference to an embodiment thereof, it will be appreciated by those skilled in the art that various changes in form and detail may be made without departing from the spirit and scope of the invention.

What is claimed is:

1. A holding system comprising:

a first container having a first base, a first side wall extending upwardly from the first base, and a first open top, the first container adapted to hold a first medicine bottle, which first medicine bottle holds a first medicine therein which first medicine is to be consumed by a person on a first regiment of time;

a plurality of first openings located on the first side wall;

at least one first label, the first label having first markings thereon that correspond to the first regiment time of the first medicine, each first label located proximate one of the plurality of first openings;

a first peg receivable within one of the plurality of first openings;

a second container having a second base, a second side wall extending upwardly from the second base, and a second open top, the second container adapted to hold a second medicine bottle, which second medicine bottle holds a second medicine therein which second medicine is to be consumed by the person on a second regiment of time;

a plurality of second openings located on the second side wall;

at least one second label, the second label having second markings thereon that correspond to the second regiment time of the second medicine, each second label located proximate one of the plurality of second openings;

a second peg receivable within one of the plurality of second openings;

wherein the first peg is received within the first opening that is located proximate the first label that corresponds to the most current first time within the first regiment that the first medicine has been consumed by the person and the second peg is received within the second opening that is located proximate the second label that corresponds to the most current second time within the second regiment that the second medicine has been consumed by the person, and wherein the base of the first container nests within the second open top of the second container.

2. The holding system as in claim 1 second wherein the first side wall is positioned in non-normal orientation relative to the first base and the second side wall is positioned in non-normal orientation relative to the second base.

3. The holding system as in claim 1 wherein the first container is attached to the second container.

4. The holding system as in claim 1 wherein the first container is removably attached to the second container.

5. The holding system as in claim 1 further comprising a first foot extending downwardly from the first base and a second foot extending downwardly from the second base.

6. A method of medication management comprising the steps of:

providing a first container having a first base, a first open top, and a first side wall extending upwardly from the first base, the first side wall having a plurality of first openings;

placing a first medicine bottle into the first container, which first medicine bottle holds a first medicine therein which first medicine is to be consumed by a person on a first regiment of time;

placing at least one first label onto the first side wall proximate one of the first openings, the first label having first markings thereon that correspond to the first regiment time of the first medicine;

providing a first peg that is receivable within one of the plurality of first openings;

providing a second container having a second base, a second open top, and a second side wall extending upwardly from the second base, the second side wall having a plurality of second openings, wherein the base of the first container nests within the second open top of the second container;

placing a second medicine bottle into the second container, which second medicine bottle holds a second medicine therein which second medicine is to be consumed by the person on a second regiment of time;

placing at least one second label onto the second side wall proximate one of the second openings, the second label having second markings thereon that correspond to the second regiment time of the second medicine;

providing a second peg that is receivable within one of the plurality of second openings; and placing first peg into the first opening that is located proximate the first label that corresponds to the most current first time within the first regiment that the first medicine has been consumed by the person and placing the second peg into the second opening that is located proximate the second label that corresponds to the most current second time within the second regiment that the second medicine has been consumed by the person.

7. The method as in claim 6 second wherein the first side wall is positioned in non-normal orientation relative to the first base and the second side wall is positioned in non-normal orientation relative to the second base.

8. The method as in claim 6 wherein the first container is attached to the second container.

9. The method as in claim 6 wherein the first container is removably attached to the second container.

10. The method as in claim 6 further comprising a first foot extending downwardly from the first base and a second foot extending downwardly from the second base.

* * * * *